US005353005A

United States Patent [19]

Salanki

[11] Patent Number: 5,353,005

[45] Date of Patent: Oct. 4, 1994

[54] LIQUID-COOLED HIGH-LOAD RESISTOR

[75] Inventor: Tibor Salanki, Erlangen, Fed. Rep. of Germany

[73] Assignee: Siemens Aktiengesellschaft, Munich, Fed. Rep. of Germany

[21] Appl. No.: 26,945

[22] Filed: Mar. 5, 1993

[30] Foreign Application Priority Data

Mar. 12, 1992 [DE] Fed. Rep. of Germany ..... 9203354

[51] Int. Cl.[5] ..... H01C 1/082

[52] U.S. Cl. ..... 338/55; 338/293

[58] Field of Search ..... 338/55, 53, 293

[56] References Cited

U.S. PATENT DOCUMENTS 4,420,739 12/1983 Herren ..... 338/53

4,434,417 2/1984 Beriger et al. ..... 338/53

*Primary Examiner*—Marvin M. Lateef

*Attorney, Agent, or Firm*—Kenyon & Kenyon

[57] ABSTRACT

A liquid-cooled high-load resistor includes an element carrier having an inlet and an outlet, a break-through and a first and second electrical terminal connection, and one resistor element, respectively, on its flat sides. The active parts of the resistor elements are electrically connected in series by means of the break-through in the element carrier and are electroconductively connected to an electrical terminal connection of the element carrier. The liquid-cooled high-load resistor further includes two covers that each cover a flat side of the element carrier, to form an enclosed space between the cover and the flat side of the element carrier. The enclosed space is subdivided so as to provide a free space in the area of the inlet, the outlet, and the break-through, and to provide a cooling channel that embeds the active part of the resistor element. Thus, one obtains a liquid-cooled high-load resistor of a relatively small size, whose self-inductance is minimal and which is capable of being loaded with a high voltage and of being operated at high power levels that entail high losses.

13 Claims, 7 Drawing Sheets

LIQUID-COOLED HIGH-LOAD RESISTOR

BACKGROUND OF THE INVENTION

The invention relates to a liquid-cooled high-load resistor.

DE 33 38 709 A1 discloses a liquid-cooled resistor in which a resistance wire is coiled around a ceramic molded component. This ceramic molded component has a platelike shape and protrusions on one plate surface. These protrusions guide the resistance wire more or less in one plane in a zigzag path. The other plate surface of the ceramic molded component is pressed against a heat sink in which flow channels run. Moreover, the resistance wire and the plate surface, on which the wire is deposited, are jointly coated with a glaze. This type of resistor does, in fact, have a low self-inductance, but is not capable of operating at high power levels that entail high losses.

German Utility Model Patent 91 00 865 discloses a liquid-cooled high-load resistor, which is comprised of a resistor element that is braced between two liquid heat sinks. An electrically insulating, heat-conducting disk is arranged between a liquid heat sink and the resistor element. The resistor element is comprised of an electrically insulating carrier member and a strip-shaped resistor material that is placed around one front end of the carrier member, so as to nearly cover the two flat sides of the carrier member. The resistor material in the area covered by the liquid heat sink is provided with slits, which allow the resistance value to be considerably increased per unit of length. Through this means, the power loss that is dissipated increases considerably. Since an electrically insulating, heat-conducting disk is provided between the resistor element and the liquid heat sink, the dielectric strength of this high-load resistor can be adapted to a desired insulating strength by properly dimensioning this disk. This liquid-cooled high-load resistor does, in fact, dissipate a high power loss in a small space, is low-inductive, and has a very high insulating strength. However, this liquid-coded high-load resistor consists of many individual components that are assembled at considerable expense.

German Utility Model Patent 91 11 719 discloses a liquid-cooled high-load resistor comprised of a housing and a resistor element. This resistor element is arranged within a chamber, which is traversed by the flow of a cooling liquid. This chamber is comprised of two insulating plates and one insulating ring. A doubly wound conductor-strip spiral is provided as a resistor element. The resistor element is braced between the two insulating plates in a way that allows the cooling liquid to flow through a rectangular channel. By configuring the resistor element directly in the pathway of the cooling liquid, so that the cooling liquid flows along on both sides of the current-carrying resistor element, a high power loss Can be dissipated by the cooling liquid. However, the use of a doubly wound conductor-strip spiral as the resistor element does not minimize the resultant inductance of the high-load resistor because of the geometry of a circular conductor. This resistor is neither simple to assemble, nor are its dimensions small.

SUMMARY OF THE INVENTION

The present invention provides a liquid-cooled high-load resistor, which has a relatively small size and minimal self-inductance, and is capable of being loaded with high voltages and operating at high power levels that entail high losses.

According to an embodiment of the present invention, the liquid-cooled high-load resistor is comprised of an element carrier, which is provided with an inlet and an outlet, a break-through and a first and second electrical terminal connection, and at least one resistor element provided on a flat side of the element carrier. A first end of an active part of this resistor element is connected by means of a break-through in the element carrier to a first electrical terminal connection, and a second end is connected to a second electrical terminal connection of the element carrier. The liquid-cooled high-load resistor is also comprised of two covers that each cover a flat side of the element carrier. The enclosed space between the cover and the flat side of the element carrier is subdivided so as to provide a free space in the area of the inlet, the outlet, and the break-through. A cooling channel is provided and embeds the active part of the resistor element.

Since the liquid-cooled high-load resistor of this embodiment of the present invention has only three parts, whereby the middle part can be prefabricated, assembly is very simple. Moreover, this high-load resistor is very compact, since the resistor element is accommodated on the flat side of the element carrier. This compact type of construction is further enhanced, since the other elements of the high-load resistor are arranged on the element carrier in a way that requires little space. Since the active part of the resistor element has a strip shape, and its free ends are spatially separated from one another by the element carrier, this liquid-cooled high-load resistor demonstrates a minimal self-inductance and can be loaded with a high voltage, for example several kV. Since the cooling liquid is directed by a cooling channel over the active part of the resistor element, a substantial cooling effect is achieved. Therefore, this high-load resistor can be operated at high power levels that entail high losses, for example several kW.

More specifically, the liquid-cooled high-load resistor of the present invention provides for a resistor element to be arranged on each flat side of the element carrier. The active part of the resistor elements are electrically connected in series through break-through in the element carrier, and each resistor element is electroconductively connected to an electrical terminal connection of the element carrier. Thus, any desired resistance value can be obtained, without having to change the spatial dimensions of the high-load resistor according to the present invention.

The liquid-cooled high-load resistor of the present invention also provides for the resistor element to be embedded in a corresponding indentation in the flat side of the element carrier in a way that allows the resistor element to lie in the same plane as the flat side of the element carrier. As a result, different resistor elements corresponding to different amperages and/or resistance values may be manufactured. Thus, standard elements make it possible for a variety of resistors to be realized and, for defective resistor elements to be easily replaced i.e., the high-load resistor can be repaired inexpensively.

The liquid-cooled high-load resistor may also be designed to provide for ribs to be arranged perpendicularly on the inner side of the cover in a way that causes a cooling channel to form. This cooling channel corresponds to the active part of the resistor element, whereby the narrow sides of these ribs are each provided with a flexible lip. The application of the perpendicular ribs makes it very simple to assemble a cooling channel that embeds the active part of the resistor element. Since the narrow sides of these ribs are each provided with a flexible lip, the cooling channel is sealed off in a liquid-tight manner when the high-load resistor is in operation. Therefore, the cooling liquid required to dissipate the power loss is not lost and the cooling effect is not diminished.

In another embodiment of the present invention, a cooling channel is formed by means of two comb-shaped interfitting pieces, whereby these interfitting pieces are arranged on either side of the active part of the resistor element to form a cooling channel. The application of these comb-shaped interfitting pieces makes it possible to adapt the cooling channel to the active part of different resistor elements. Moreover, assembly is considerably simplified since the corresponding comb-shaped interfitting pieces need only be placed on the resistor element and affixed to the covers.

BRIEF DESCRIPTION OF THE DRAWINGS

To further clarify the invention, reference is made to the drawings, in which several exemplified embodiments of the liquid-cooled high-load resistor according to the present invention are schematically illustrated.

DETAILED DESCRIPTION

Figure 1:
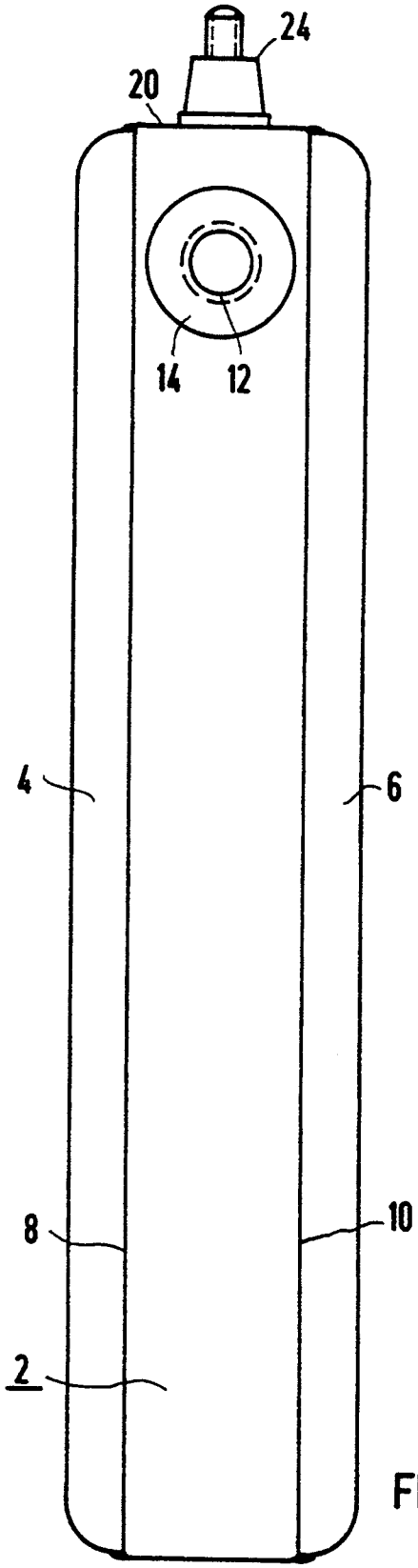
FIG. 1 depicts a lateral view of a liquid-cooled high-load resistor of the present invention.

FIG. 1 shows a side view of a liquid-cooled high-load resistor according to an embodiment of the present invention, which is comprised of one element carrier 2 and two covers 4 and 6. The covers 4 and 6 substantially cover the flat sides 8 and 10 of the element carrier 2. In this depiction, the covers 4 and 6 are welded to the element carrier 2. Any other bonding method that bonds the covers 4 and 6 to the element carrier 2 in a liquid-tight manner may be utilized. Element carrier 2 and the two covers 4 and 6 are made of plastic, and may be plastic injection-molded parts. The element carrier 2 has a tapped hole 12 on the side, that serves as a hook-up for a cooling-liquid line, so that cooling liquid can be supplied. An annular disk 14 reinforces this tapped hole 12. Another connection, consisting of a tapped hole 16 with an annular disk 18 as reinforcement, is configured on the opposite side of the element carrier 2.

These two connections serve as an inlet and outlet for the cooling liquid of the high-load resistor. A top end 20 of the element carrier 2 is provided with two electrical terminal connections 22 and 24 (electrical terminal connection 22 is not shown).

Figure 2:
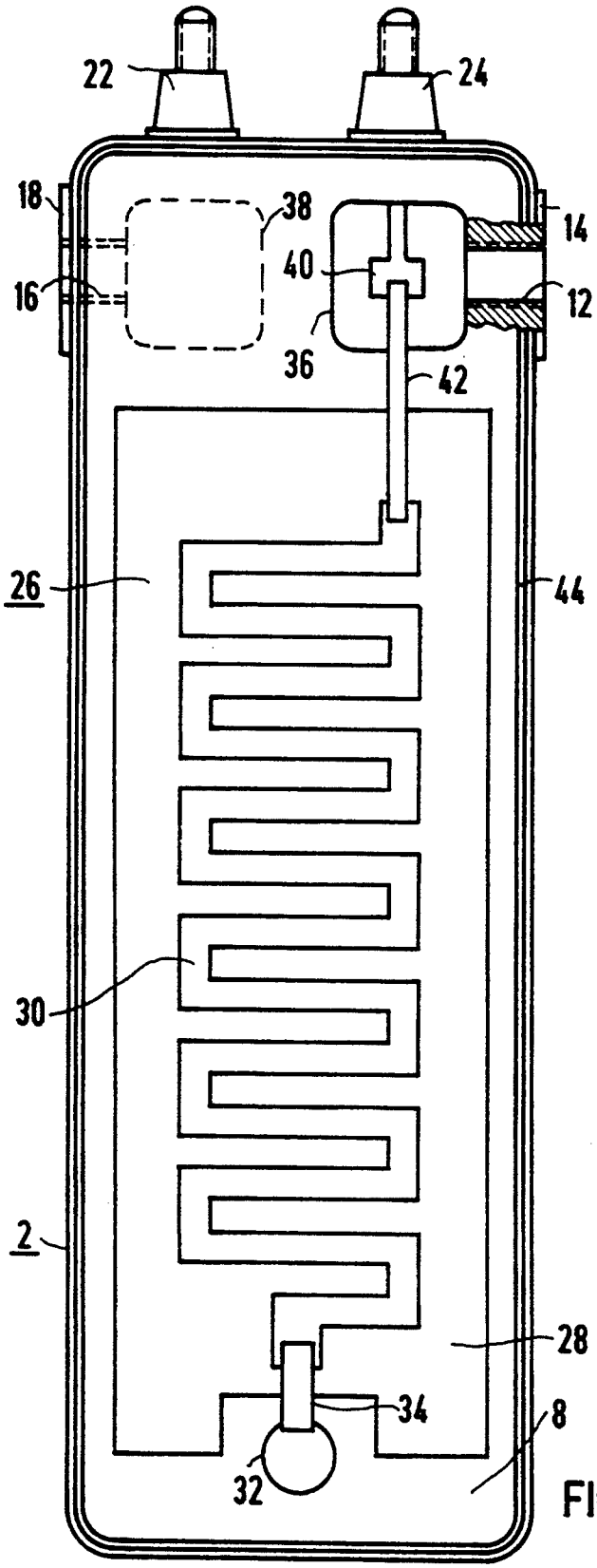
FIG. 2 shows the front view of an open high-load resistor shown in FIG. 1.

A front view of an open high-load resistor according to FIG. 1 is shown in FIG. 2. In FIG. 2, the cover 4 has been omitted to permit an unobstructed view of the flat side 8 of the element carrier 2.

The flat side 8 and the flat side 10 (not shown) of the element carrier 2 are each provided with a resistor element 26. It is also possible, however, to provide only one flat side 8 or 10 with a resistor element 26, when a small resistance value is desired. This resistor element 26 consists of a passive part 28 and an active part 30. A metal foil may be provided as a resistor element 26. The active part 30 is produced from this metal foil through an etching process.

The active part 30 is, for example, serpentine-shaped, to minimize self-inductance. The metal foil 26 is fabricated from a resistance alloy, for example nickel chromium (NiCr 80/20) or manganite. The metal foil 26 is adhered to a flat side 8 or 10 of the element carrier 2 before the chemical etching process is carried out. The etching operation is carried out by photolithographic methods. The two active parts 30 of the resistor elements 26 are electrically connected in series by means of a break-through 32 and a metal strip 34 made of the alloy of the resistor element 26. The tapped hole 12 or 16 opens through to a recess 36 or 38, whereby the opening of the recess 36 lies in the plane of the flat side 8, and the opening of the recess 38 lies in the plane of the flat side 10 of the element carrier 2. The electrical terminal connections 22 and 24 and the recesses 38 and 36 are spatially oriented in a way that allows a connector tongue 40 of the electrical terminal connections 22 and 24 to be arranged in the recess 38 or 36. The free ends of the active parts 30 of the resistor elements 26 of the flat sides 8 and 10 are electroconductively connected to the connector tongues 40 by means of a metal strip 42. These metal strips 42 are also manufactured from the alloy of the resistor element 26.

In addition, the flat side 8 or 10 is provided with a circular groove 44, which receives the cover 4 or 6. The cover 4 or 6 is spatially affixed by means of the groove 44 to the flat side 8 or 10 of the element carrier 2. The groove 44 can also have a narrow design, which enables the cover 4 or 6 to be clamped within the element carrier 2. Thus, assembly is considerably simplified and the welding of the element carrier to covers 4 and 6, respectively is unnecessary.

Figure 3:
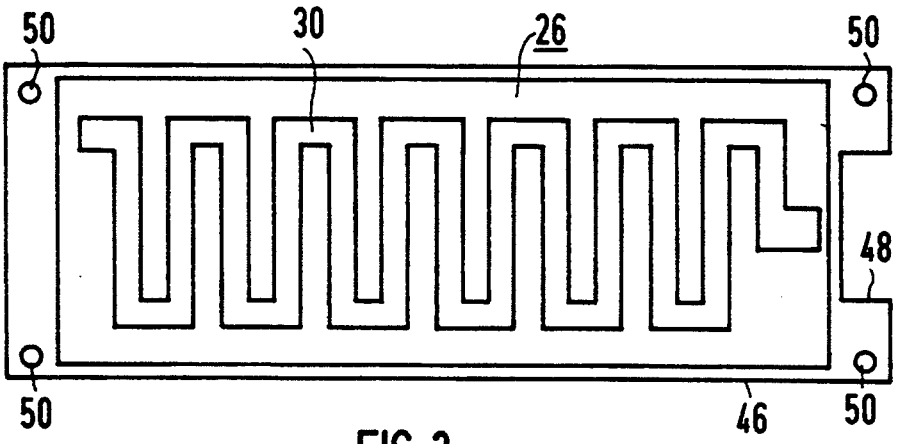
FIGS. 3 and 4 illustrate two different embodiments of a resistor element which might be incorporated in accordance with the present invention.
Figure 4:
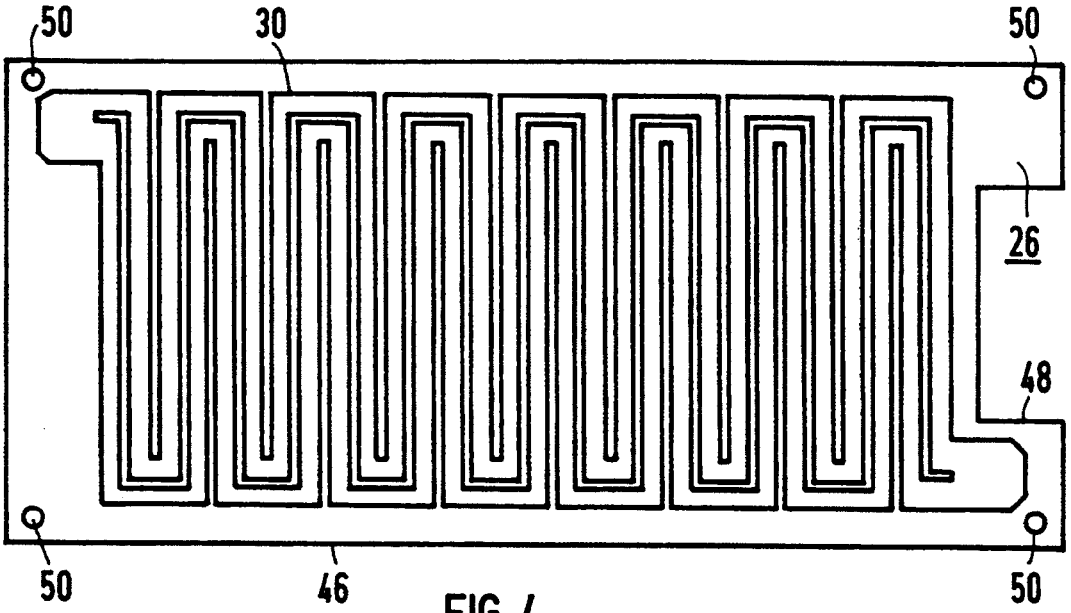

FIGS. 3 and 4 show other embodiments of the resistor element 26. In these specific embodiments, the metal foil 26 is adhered to a bearing plate 46. The bearing plate 46 has a cut-out 48 at its front end. As a result, the positioning of the bearing plate 46 is firmly established in the element carrier 2. Each corner of this bearing plate 46 is preferably provided with a bore hole 50. In the specific embodiment according to FIG. 3, a serpentine-shaped printed conductor is provided as an active part 30. In the specific embodiment of FIG. 4, the active part 30 is made up of two electrically parallel-connected, serpentine-shaped printed conductors. Moreover, in the embodiment illustrated in FIG. 4, the basic form of the metal foil 26 corresponds to the basic form of the bearing plate 46, and not every corner is provided with a bore hole 50. This specific embodiment of FIG. 4, wherein the active part 30 comprises two serpentine-shaped printed conductors, is recommended when the desired resistance value is between 0.01 Ω and 0.2 Ω, and the value of the amperage is between 100 A and 400 A.

Figure 5:
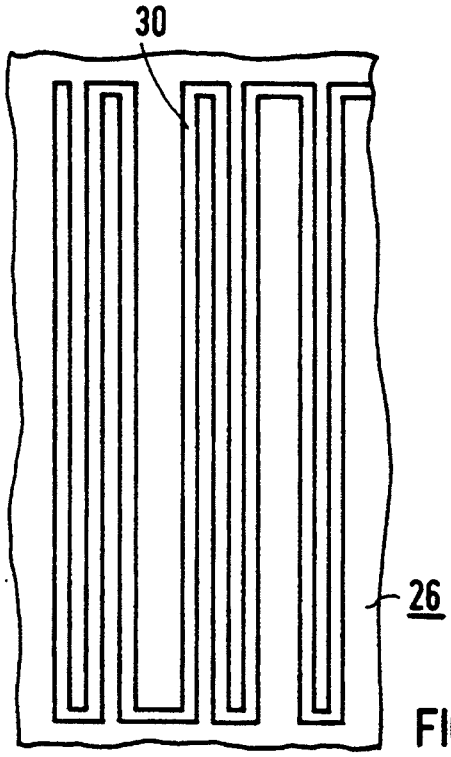
FIG. 5 illustrates a cut-away portion of an active part of the resistor element of the present invention.

A cut-away portion of another specific embodiment of the active part 30 of the resistor element 26 is depicted in greater detail in FIG. 5. The exceptional feature of this embodiment of the active part 30 is that the clearance between the individual serpentine-shaped printed conductors varies. In this case, the clearances 80 after two segments of the conductor is larger than the clearance 81 between the two segments of the conductor. By forming the active part 30 in this manner, three printed conductors (instead of one (FIG. 2) or two (FIG. 4)) are simultaneously cooled by the cooling liquid. In the case of the specific embodiment according to FIG. 5, the resistance value increases considerably. This finely structured design is preferred when the desired resistance value is 1 Ω, and up to 80 Ω.

Figure 6:
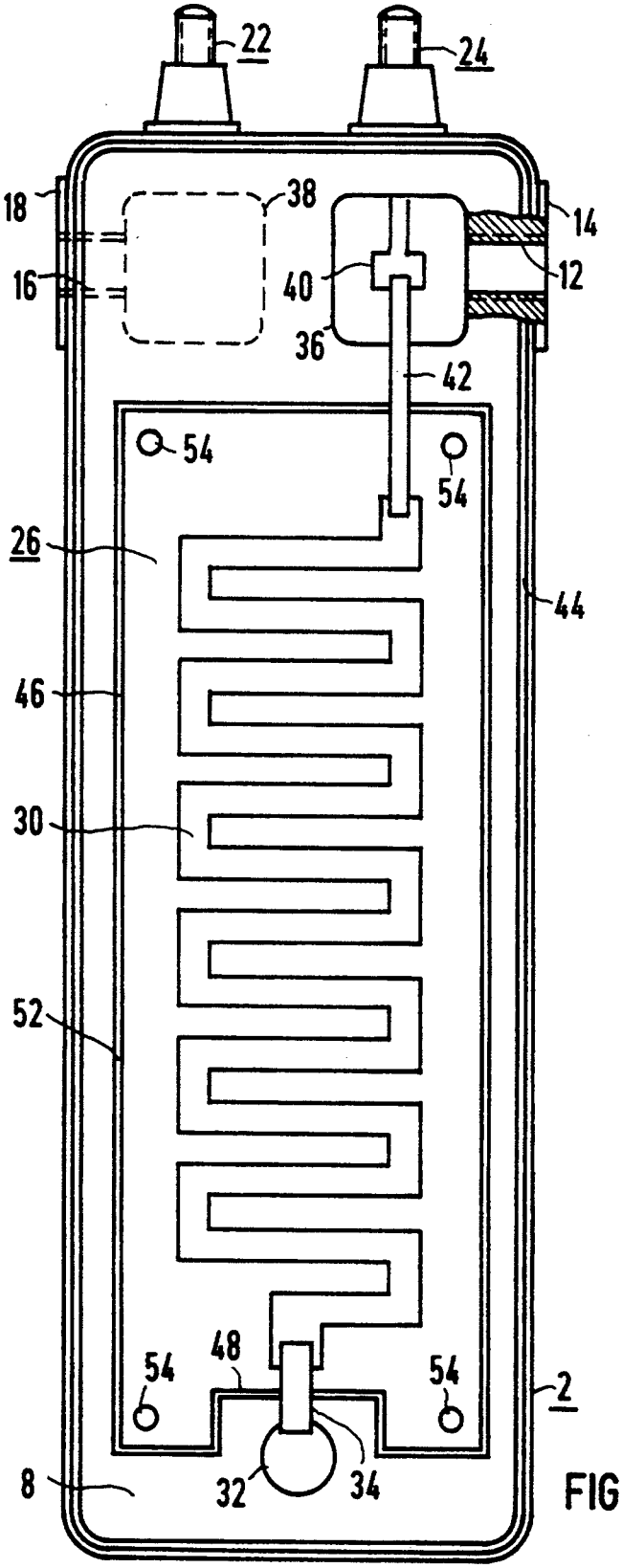
FIG. 6 depicts a front view of a second embodiment of the open high-load resistor of the present invention.

Another embodiment of an open high-load resistor is shown in FIG. 6. The resistor element 26 in this embodiment is adhered to a bearing plate 46. Therefore, the element carrier 2 is provided on both sides with an indentation 52 which corresponds to the bearing plate 46. The depth of this indentation 52 corresponds to the thickness of the bearing plate 46 and the resistor element 26, so that the resistor element 26 and the flat side 8 or 10 form one plane. The bearing plate 46 can be detachably secured by means of pins or plastic studs 54 to the element carrier 2.

Figure 8:
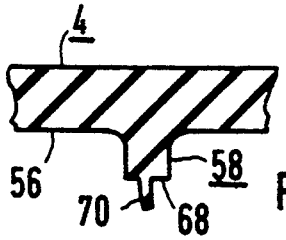
FIG. 8 illustrates an enlargement of a cut-away portion VIII of FIG. 7.
Figure 7:
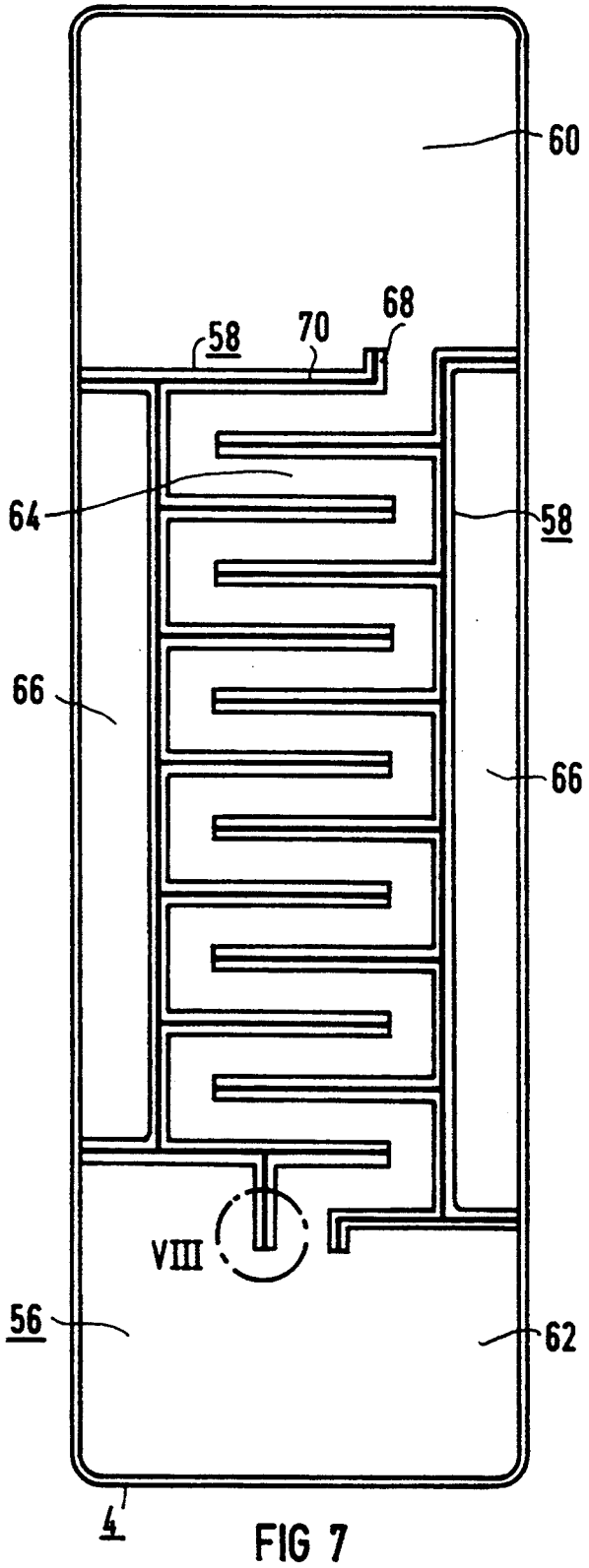
FIG. 7 shows an inner side of a cover of the high-load resistor of the present invention.

FIG. 7 shows the inner side 56 of the cover 4 of the high-load resistor according to FIG. 1. On this inner side 56, ribs 58 are arranged perpendicularly, so as to allow the inner side 56 to be subdivided into an upper free space 60, a lower free space 62, and a cooling channel 64. The cooling channel 64 interconnects these free spaces 60 and 62. Given an operationally ready high-load resistor, the result of this partitioning is that cooling channel 64 embeds the active part 30 of the resistor element 26, the free space 60 is arranged above at the recess 36 or 38, and the free space 62 is arranged above the break-through 32. This formation allows the cooling medium to enter the free space 60 via the inlet of the cooling liquid that consists of the internal tapped hole 12 and the recess 36 as shown in FIG. 1. From there, the cooling medium can only enter the free space 62 through the cooling channel 64, whereby it absorbs the power loss of the active part 30. From there, the cooling medium traverses the break-through 32 and enters the free space at the rear side of the high-load resistor. It flows from there through the cooling channel to the free space at recess 38 and then to the outside via the internal tapped hole 16. To ensure that the cooling liquid cannot flow laterally out of the cooling channel 64 into the two hollow spaces 66, or that it cannot leak through at right angles to the flow direction in the cooling channel, the narrow side 68 of each rib 58 is provided with a flexible lip 70. An enlarged cut-away portion VIII of FIG. 7 is shown in FIG. 8. It depicts a rib 58 with a corresponding lip 70.

Figure 9:
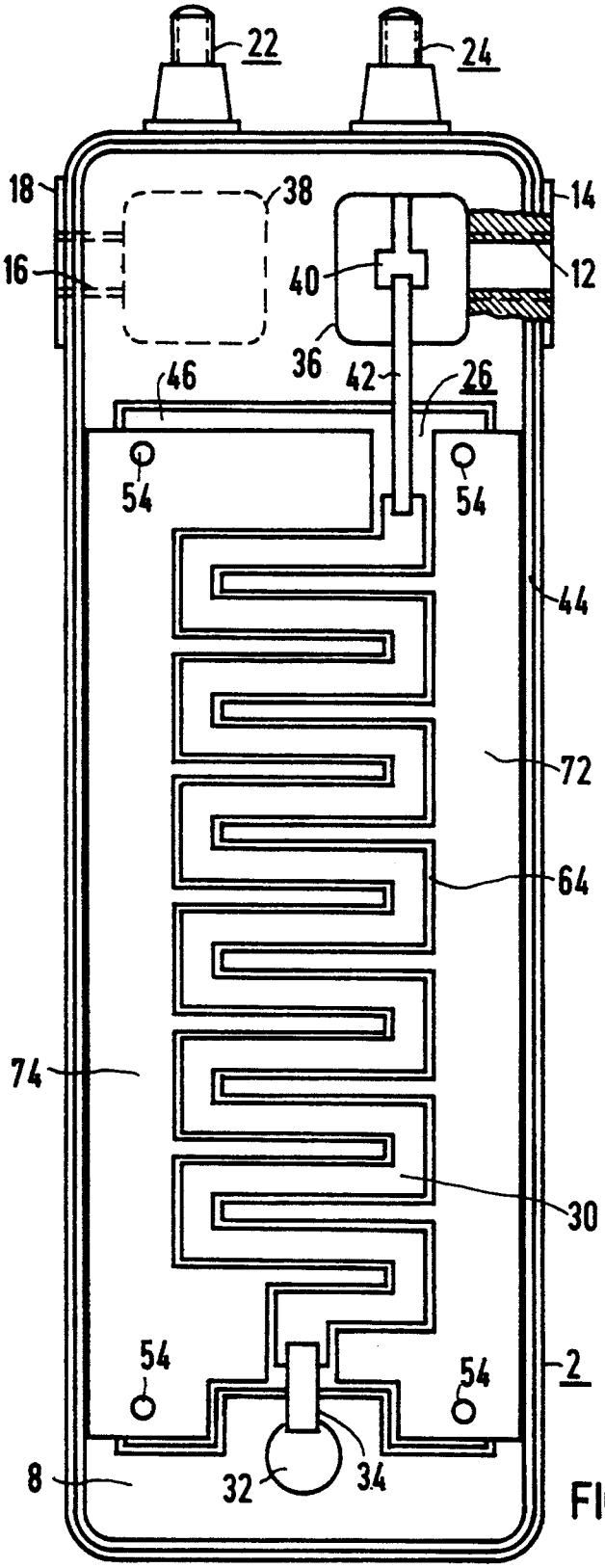
FIG. 9 depicts a front view of a third embodiment of the open high-load resistor of the present invention.

FIG. 9 depicts in greater detail another embodiment of an open high-load resistor. The flat side 8 of the element carrier 2 is provided with two comb-shaped interfitting pieces 72 and 74. The shape of these comb-shaped interfitting pieces 72 and 74 causes them to embed the active part 30 of the resistor element 26. This means that these comb-shaped interfitting pieces 72 and 74 and the cover 4 or 6 form a cooling channel 64, in which the cooling liquid can flow from the recess 36 through the cooling channel 64, the break-through 32, and the cooling channel at the rear side to the recess 38. These two interfitting pieces 72 and 74, together with the bearing plate 46, can be detachably connected by means of the pins 54 to the element carrier 2. This embodiment provides an advantageous solution when that element carrier 2 is to be equipped with various resistor elements having an active part 30 that is comprised of either one, two, or three meander-shaped printed conductors.

The refinement of the high-load resistor according to the present invention makes it possible for a liquid-cooled high-load resistor to be relatively small, whereby the value of the resistance can be varied from 0.01 Ω to 80 Ω. Moreover, this liquid-cooled high-load resistor has a minimal self-inductance. Also, this resistor is capable of being loaded with high voltages (several kV) and of being operated at high power levels that entail high losses (several kW). One advantageous application is to use this liquid-cooled high-load resistor as a protective-circuit resistor for gate turn-off thyristors.

What is claimed:

1. A liquid-cooled high-load resistor, comprising:

an element carrier having an inlet and an outlet through which cooling liquid passes, a break-through and a first and second electrical terminal connection;

at least one resistor element provided on a flat side of the element carrier, and having an active part wherein a first end of the active part of said at least one resistor element is connected by means of said break-through to said first electrical terminal connection and a second end of the active part of said resistor element is connected to said second electrical terminal connection; and two covers that each cover a flat side of said element carrier, wherein an enclosed space is respectively formed between each cover and a flat side of said element carrier, and said enclosed space is subdivided to provide a free space in the area of the inlet, the outlet and the break-through, and to provide a cooling channel that embeds the active part of said resistor element.

2. The liquid-cooled high-load resistor according to claim 1, wherein a resistor element is arranged on each flat side of the element carrier and wherein the active parts of said resistor elements are electrically connected in series by means of the break-through and electrically connected respectively to an electrical terminal connection of the element carrier.

3. The liquid-cooled high-load resistor according to claim 1, wherein an indentation which corresponds to the resistor element is provided on the element carrier, and the resistor element is embedded in said indentation of the element carrier so that the surface of the resistor element lies in the same plane with the flat side of the element carrier.

4. The liquid-cooled high-load resistor according to claim 1, wherein each of said two covers is provided with ribs having a flexible lip provided on a narrow side of said ribs, and are arranged perpendicularly on an inner side of the cover to form a cooling channel that corresponds to the active part of the resistor element.

5. The liquid-cooled high-load resistor according to claim 1, wherein the cooling channel is formed by two comb-shaped interfitting pieces that are arranged on both sides of the active part of the resistor element.

6. The liquid-cooled high-load resistor according to claim 1, wherein the inlet and the outlet of the element carrier are recesses in the element carrier that are laterally accessible from the outside of the element carrier by way of a tapped hole in said element carrier.

7. The liquid-cooled high-load resistor according to claim 1, wherein the resistor element is metal foil, and the active part of the resistor element is a serpentine-shaped printed conductor.

8. The liquid-cooled high-load resistor according to claim 1, wherein the resistor element is a bearing plate coated with a metal foil and the active part of the resistor element is a serpentine-shaped printed conductor.

9. The liquid-cooled high-load resistor according to claim 1, wherein the element carrier and the two covers are made of plastic.

10. The liquid-cooled high-load resistor according to claim 4, wherein the active part of the resistor element is made of a resistance alloy.

11. The liquid-cooled high-load resistor according to claim 2, wherein an indentation which corresponds to the resistor element is provided on the element carrier, and the resistor element is embedded in said indentation of the element carrier so that the surface of the resistor element lies in the same plane with the flat side of the element carrier.

12. The liquid-cooled high-load resistor according to claim 2, wherein the cooling channel is formed by two comb-shaped interfitting pieces that are arranged on both sides of the active part of the resistor element.

13. The liquid-cooled high-load resistor according to claim 2, wherein the resistor element is metal foil, and the active part of the resistor element is a meander-shaped printed conductor.

* * * * *